US005538345A

United States Patent [19]

Gotoh et al.

[11] Patent Number: 5,538,345

[45] Date of Patent: Jul. 23, 1996

[54] EASY-OPEN, HERMETICALLY-SEALED, PACKAGING BAG

[75] Inventors: Shuichi Gotoh; Hiroshi Odaka, both of Tokyo, Japan

[73] Assignee: Idemitsy Petrochemical Co., Ltd., Tokyo, Japan

[21] Appl. No.: 325,586

[22] Filed: Oct. 19, 1994

[30] Foreign Application Priority Data

Oct. 19, 1993 [JP] Japan ..... 5-283916

[51] Int. Cl.[6] ..... B65D 33/16

[52] U.S. Cl. ..... 383/210

[58] Field of Search ..... 383/210, 94

[56] References Cited

U.S. PATENT DOCUMENTS 4,518,087 5/1985 Goglio ..... 383/210
5,330,269 7/1994 Kamada et al. ..... 383/210

FOREIGN PATENT DOCUMENTS 0358465 3/1990 European Pat. Off. .
0516276 12/1992 European Pat. Off. .
0541093 5/1993 European Pat. Off. .

*Primary Examiner*—Stephen P. Garbe
*Attorney, Agent, or Firm*—Antonelli, Terry, Stout & Kraus

[57] ABSTRACT

An easy-open, hermetically-sealed, packaging bag 1 whose opening end is heat-sealed, with a sealing material interposed therein, wherein the sealing material comprises (a) an intermediate resin strip comprising a low-sealable resin layer and (b) two outer resin strips, the outsides of the outer resin strips being strongly bonded to the inside of the packaging bag by heat-sealing and being weakly melt-bonded to both sides of the intermediate resin strip, the innermost ends of the melt-bonded interfaces between the intermediate resin strip and the outer resin strips are located inner in the packaging bag than the innermost ends of the heat-sealed parts between the packaging bag and the outer resin strips.

5 Claims, 4 Drawing Sheets

EASY-OPEN, HERMETICALLY-SEALED, PACKAGING BAG

BACKGROUND OF THE INVENTION (a) Field of the Invention

The present invention relates to easy-open, hermetically-sealed, packaging bags which are suitable for packaging boil-in-pouch foods or retort-in-pouch foods.

(b) Description of the Related Art

Hermetically-sealed bags are usually produced by filling a packaging bag with a content through an open end, closing the open end to make contact between two opposite sides of the inside of the packaging bag and then heat-sealing the opposite sides to each other. The thus produced hermetically-sealed packaging bags are unsatisfactory because when the sealability is increased by increasing the heat-sealing strength, the opening nature is deteriorated, requiring cutlery for opening to use the contents. Particularly, packaging bags to be subjected to heat processing, such as retort sterilization, needs such a high sealability as to stand the internal pressure increased by the heat processing, and are difficult to endow with good opening nature.

A method proposed to solve this problem is to heat-seal at relatively low heat-sealing temperature the inside of the open end of a packaging bag, with a sealing material which is composed of two strips bonded to each other with an adhesive and which can make a good seal with the inside of the packaging bag. This method provides a hermetically-sealed packaging bag, which has a high sealability and also has a good opening nature ensured by the peeling between the surfaces bonded by the adhesive. This method however, is poor in the productivity because of the complicated procedures for applying adhesives.

SUMMARY OF THE INVENTION

The object of the present invention is to provide an easy-open, hermetically-sealed, packaging bag which exhibits both good opening nature and high sealability without the aid of adhesives.

The inventors made researches to solve the above-described problems and found that easy-open, hermetically-sealed, packaging bags excellent both in sealability and in opening nature were obtainable by heat-sealing the inside of the opening end of packaging bags, with a layered sealing material of a specific layer structure interposed therein. Based on this finding, the inventors have completed the present invention.

That is, the present invention provides an easy-open, hermetically-sealed, packaging bag, comprising a packaging bag 1 and a sealing material in a strip form, the packaging bag having an opening end which is hermetically sealed, with the sealing material interposed therein, and with the inside of the opening end strongly bonded to both sides of the sealing material by heat-sealing to form two heat-sealed parts 9 between the inside of the packaging bag 1 and the both sides of the sealing material, the sealing material comprising (a) an intermediate resin strip 2 comprising a poorly sealable resin layer 3 which is hard to bond to the inside of the packaging bag 1 by heat-sealing and (b) two outer resin strips 6 and 7 which are weakly melt-bonded respectively to both sides of the intermediate resin strip 2 to form two melt-bonded interfaces 8 between the intermediate resin strip 2 and the outer resin strips 6 and 7, the innermost ends b of the melt-bonded interfaces 8 being located more inwardly in the packaging bag 1 than the innermost ends of the heat-sealed parts 9.

DESCRIPTION OF THE PREFERRED EMBODIMENTS

Figure 1:
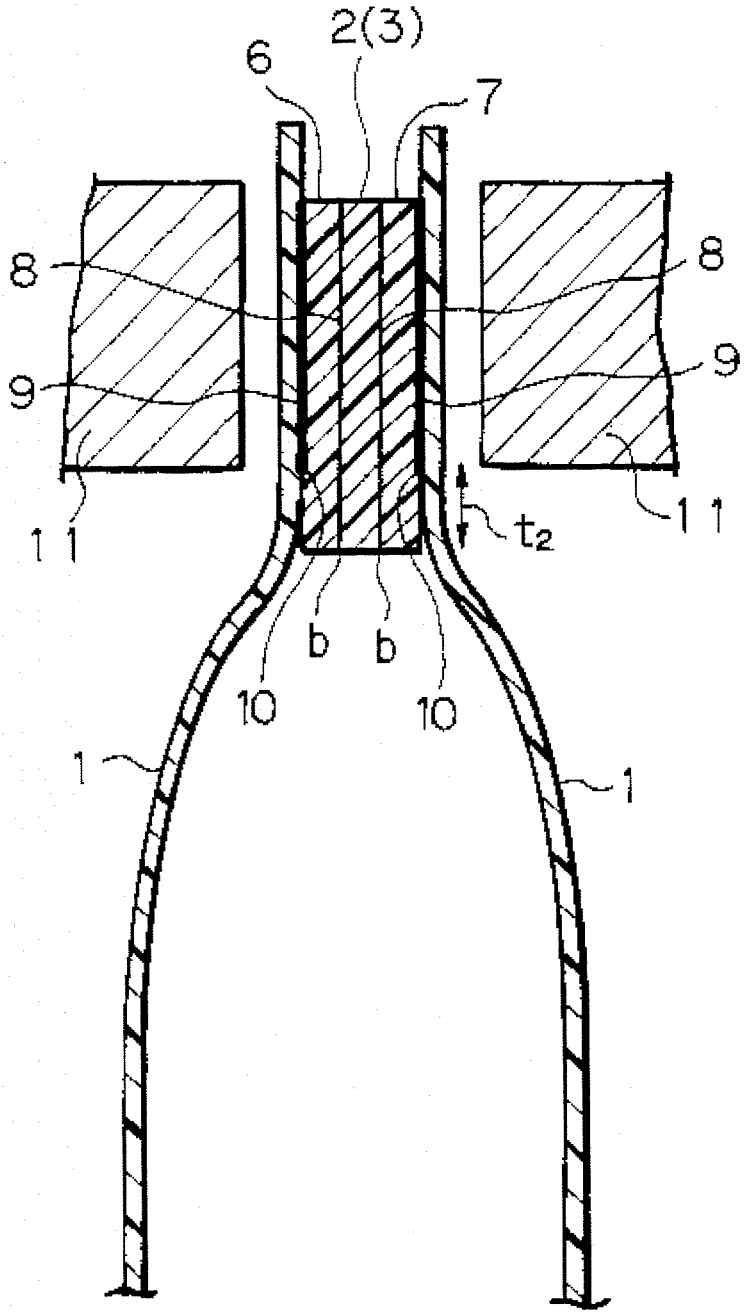
FIG. 1 is a partially sectional view of an embodiment of the easy-open, hermetically-sealed, packaging bag according to the present invention, illustrating the part for opening.

Hereinafter, the present invention will be described in detail referring to drawings. FIG. 1 is a partially sectional view of an embodiment of the easy-open, hermetically-sealed, packaging bag according to the present invention, illustrating the structure of the opening end of the packaging bag. The referential numeral 1 represents a packaging bag which is made of synthetic resin and is composed of a single layer strip or a multilayer strip, for example, of a polyethylene, a polypropylene, a polyester, a polyamide or a polyvinylchloride. In case of a packaging bag composed of a multilayer sheet, the outer layer (to come contact with sealing bars 11) of the multilayer sheet preferably has a higher melting point than that of the inner layer (to be used for sealing). An example of the preferred combination of the resins is a combination of an oriented nylon for the outer layer and a polypropylene for the inner layer.

The referential numeral 2 represents an intermediate resin strip, which, in FIG. 1, consists of a poorly sealable resin layer 3 which is hard to bond to the inside of the packaging bag 1 by heat-sealing. The intermediate resin strip 2 is weakly melt-bonded to the outer resin strips 6 and 7 on two melt-bonded interfaces 8. The peeling strength of the melt-bonded interfaces 8 is preferably 300 to 1,500 g/15 mm. The outside of each of the outer resin strips 6 and 7 is strongly bonded by heat-sealing to the inside of the packaging bag 1 at two heat-sealed parts 9. The peeling strength of the heat-sealed parts 8 is preferably 6 to 8 kg/15 mm. In the case where the inner layer of the packaging bag 1 is a polypropylene layer, the low-sealable resin layer 3 is preferably a layer of a linear low density polyethylene, and the outer resin strips 6 and 7 are preferably strips of a polypropylene. The outer resin strips 6 and 7 also may be of different resins so that one of the melt-bonded interfaces 8 is easily peelable and the other is hard to peel.

The sealing material shown in FIG. 1 may be a three-layer strip produced by three-layer extrusion.

When the easy-open, hermetically-sealed, packaging bag of the present invention is opened, easy open is attained by the peeling on one of the melt-bonded interfaces 8 on which intermediate resin strip 2 (poorly sealable layer 3) is weakly melt-bonded to the outer resin strips 6 and 7.

Since the innermost ends b of the melt-bonded interfaces 8 between the intermediate resin strip 2 and the outer resin strips 6 and 7 are located more inwardly in the packaging bag 1 than the innermost ends 10 of the heat-sealed parts 9 between the packaging bag 1 and the sealing material, the internal pressure, during the hermetical sealing is maintained, can be concentrated at the innermost ends 10 of the parts strongly bonded by heat-sealing, to give good sealability against internal pressure.

The preferred distance $t_2$ as shown in FIG. 1 between b, namely the innermost ends b of the melt-bonded interfaces 8 between the intermediate resin strip 2 and the outer resin strips 6 and 7, and 10, namely the innermost ends of the heat-sealed parts 9 between the packaging bag 1 and the sealing material, is generally at least 0.5 mm, more preferably 5 to 30 mm.

Figure 2:
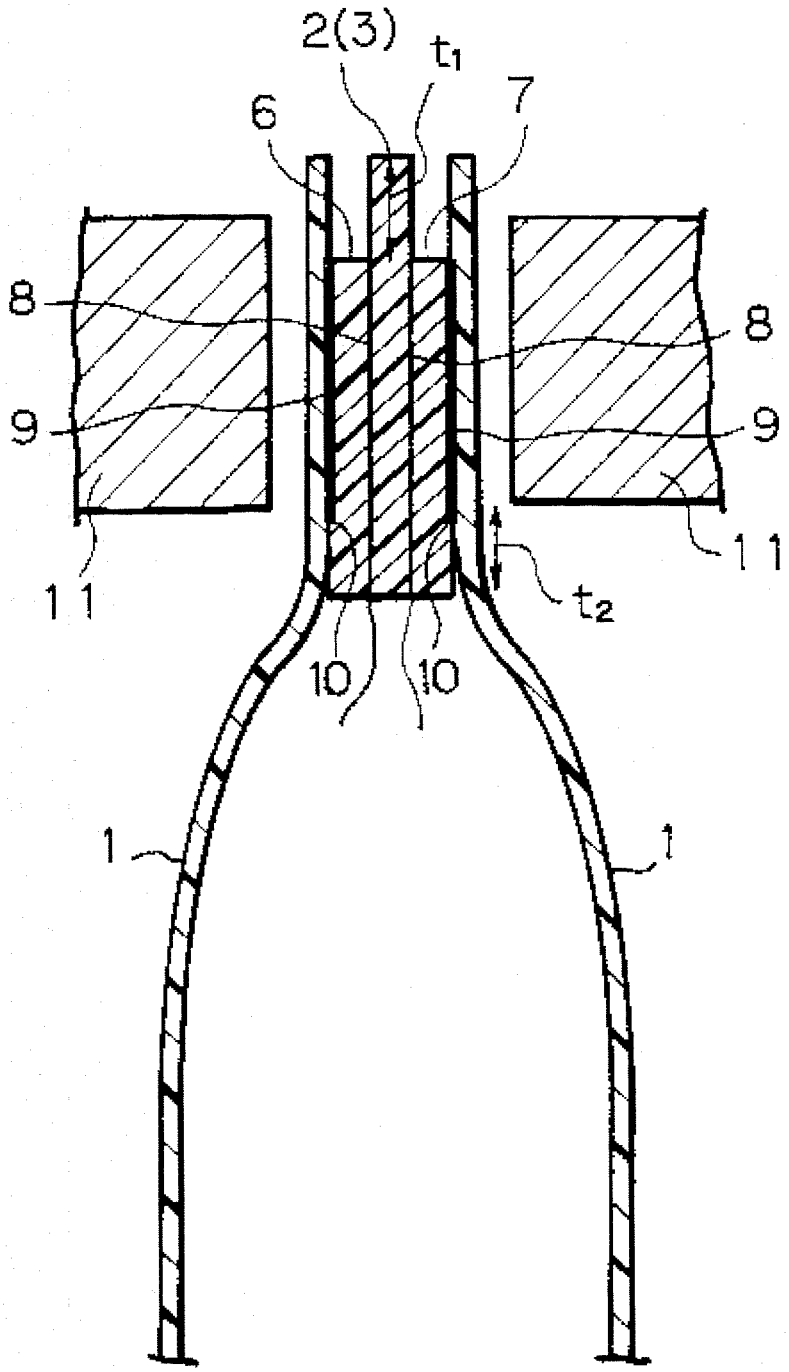
FIG. 2 is a partially sectional view of another embodiment of the easy-open, hermetically-sealed, packaging bag according to the present invention, illustrating the part for opening.

FIG. 2 is a partially sectional view of another embodiment of the easy-open, hermetically-sealed, packaging bag according to the present invention. In this embodiment, the outermost end of the intermediate resin strip, namely the resin layer 3, is located more outwardly toward the outside of the packaging bag 1 than the outermost ends of the outer resin strips 6 and 7, so that opening is performed easily by the concentration of the applied stress at one of the outermost ends of the melt-bonded interfaces 8, and so that the opposite sides of the inside of the packaging bag 1 are prevented from bonding to each other and making opening difficult. The distance between the outermost end of the resin layer 3 and the outermost ends of the outer resin strips 6 and 7, namely $t_1$ in FIG. 2, is preferably at least 0.5 mm, more preferably 5 to 30 mm.

Figure 3:
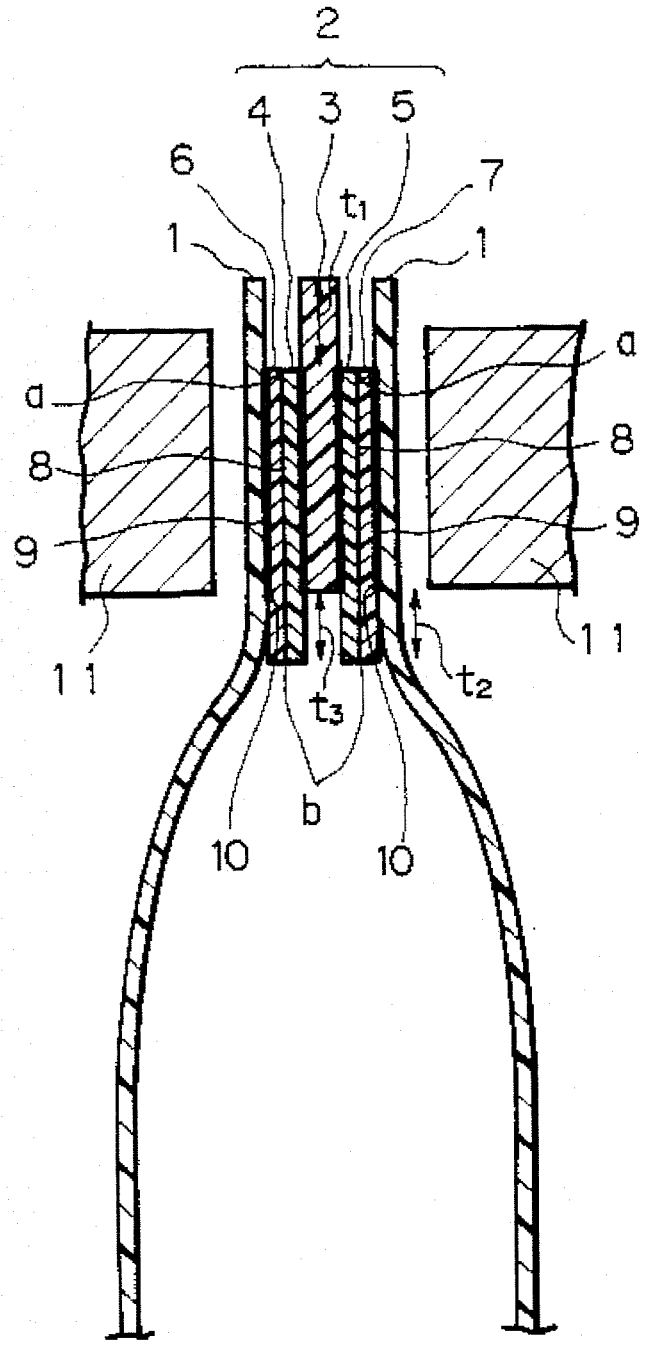
FIG. 3 is a partially sectional view of another embodiment of the easy-open, hermetically-sealed, packaging bag according to the present invention, illustrating the part for opening.

FIG. 3 is a partially sectional view of another embodiment of the easy-open, hermetically-sealed, packaging bag according to the present invention. The packaging bag 1 may also be composed of a single layer strip or a multilayer strip, and the preferred resins and combinations thereof are the same as those described above. The intermediate resin strip 2 is composed of a resin layer 3 and two resin layers 4 and 5 sandwiching the resin layer 3. The resin layer 3 is strongly melt-bonded to the resin layers 4 and 5. The peeling strength between the resin layer 3 and the resin layers 4 and 5 is preferably 6 to 8 kg/15 mm. The resin layer 3 and the resin layers 4 and 5 may be made of the same resin, and also may be previously united in one body. The resin layers 4 and 5 of the intermediate resin strip 2 is weakly melt-bonded to the outer resin strips 6 and 7 on two melt-bonded interfaces 8. The outside of each of the outer resin strips 6 and 7 is strongly bonded to the inside of the packaging bag 1 at two heat-sealed parts 9. The preferred peel strength of the melt-bonded interfaces 8 and the heat-sealed parts 9 is the same as described above. The resins and combinations thereof which are suitable for the inner layer of the packaging bag 1, the resin layer 3 and the outer resin strips 6 and 7 are the same as those described above.

When the easy-open, hermetically-sealed, packaging bag 1 as shown in FIG. 3 is opened, easy open is attained by the peeling on one of the melt-bonded interfaces 8. In this embodiment, the outermost end of the resin layer 3 of the intermediate resin strip 2 is located father toward the outside of the packaging bag 1 than the outermost ends of the outer resin strips 6 and 7, so that opening is performed easily by the concentration of the applied stress at one of the outermost ends of the melt-bonded interfaces 8, and so that the opposite sides of inside of the packaging bag 1 are prevented from bonding to each other and making opening difficult. The distance between the outermost end of the resin layer 3 and the outermost ends of the outer resin strips 6 and 7, namely $t_1$ in FIG. 3 may be 0 mm, but preferably be at least 0.5 mm, more preferably 5 to 30 mm.

Further, since the innermost ends b of the melt-bonded interfaces 8 between the intermediate resin strip 2 (outer resin layers 4 and 5) and the outer resin strips 6 and 7 are located more inwardly in the packaging bag 1 than the innermost ends 10 of the heat-sealed parts 9 between the packaging bag 1 and the sealing material, the internal pressure can be concentrated at the innermost ends 10 of the parts strongly bonded by heat-sealing while the hermetical sealing is maintained, to give good sealability against internal pressure.

The preferred distance $t_2$ as shown in FIG. 3 is the same as that described above.

The intermediate resin strip 2 as shown in FIG. 3 has a multilayer structure wherein the innermost ends of the resin layers 5 and 6 are arranged more inwardly in the packaging bag 1 than the innermost end of the resin layer 3 by a distance $t_3$, and such an intermediate resin strip can further improve the sealability of the packaging bag 1, as compared with an intermediate resin strip with an even innermost end line. The preferred distance $T_3$ is generally at least 0.5 mm, more preferably 5 to 30 mm.

Figure 4:
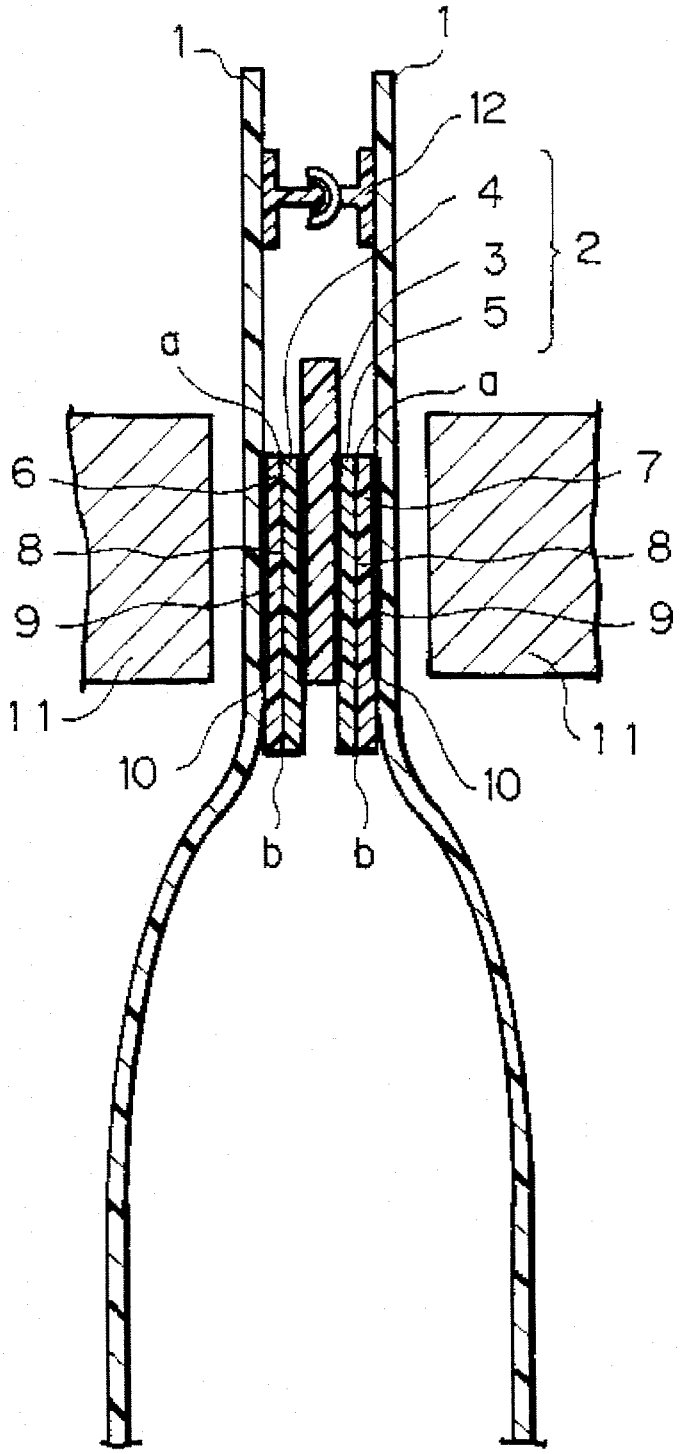
FIG. 4 is a partially sectional view of another embodiment of the easy-open, hermetically-sealed, packaging bag according to the present invention, illustrating the part for opening.

The easy-open, hermetically-sealed, packaging bag of the present invention as shown in FIG. 4 is provided with a fastening tape 12 inside the opening end and outer than the sealing area, to give a retort pouch which can be opened and sealed repeatedly.

The easy-open, hermetically-sealed, packaging bag of the present invention is obtainable by filling a packaging bag made of a synthetic resin with a content through an opening end, closing the opening end so that the inside of the packaging bag consists of two sides opposing to each other, with a sealing material or the strip materials constructing the sealing material interposed in the opening end, and then bonding the inside of the packaging bag to the both sides of the sealing material by heat-sealing.

Herein heat-sealing means various heat-sealing techniques using thermal energy, such as heat-sealing using an ordinary heat-sealer using heat and pressure, impulse heat-sealer, high-frequency dielectric sealer or ultrasonic sealer.

The melt-bonding between the layers in the sealing material may be performed at the time of heat-sealing the packaging bag with sealing bars 11, with the strip materials constructing the sealing materials interposed in the predetermined positions, or may be performed previous to the heat-sealing of the packaging bag, or may be partially performed before the sealing material is interposed in the packaging bag and then be completed at the time of the heat-sealing.

To attain stably good opening nature, it is preferable to use, as parts of the sealing material, multilayer strips weakly melt-bonded (for example, a multilayer strip consisting of the layers 4 and 6 and a multilayer strip consisting of the layers 5 and 7). Some examples of the resin combinations in such multilayer strips include a combination of a polypropylene and a linear low density polyethylene and a combination of a polypropylene and a mixture of a polybutene-1 and an ethylene-vinyl acetate copolymer. Each of the multilayer strips is preferably so arranged in the packaging bag so that a resin layer of a higher melting point is located at the outermost side of the sealing material.

Hereinafter the present invention will be described in detail referring to the following Examples, which however do not limit the scope of the present invention.

EXAMPLES 1 TO 6 AND COMPARATIVE EXAMPLES 1 AND 2

As shown in FIG. 1, the opening end of each packaging bag 1 made of a two layer strip of the layer structure as listed in Table 1 was closed so that the inside of the packaging bag consists of two sides opposing to each other, with a sealing material having the layer structure as listed in Table 1 interposed in the open end, and then the packaging bag 1 was so sealed by heat-sealing the opening end under the conditions as listed in Table 1 at a sealing width of 5 mm and at a sealing pressure of 4 kgf/cm$^2$ as to give the distances $t_1$ and $t_2$ as listed in Table 1. At the time of interposing the sealing material, two-layered strips (a strip consisting of layers 6 and 4 and a strip of layers 5 and 7) each of which had previously been melt extruded were placed on both sides of a low-sealable resin layer 3. The sealed packaging bags were opened and the results are listed in Table 1.

In Table 1, ONY represents an oriented nylon, CPP a polypropylene, LLDPE a linear low density polyethylene, PB-1 a polybutene-1 and EVA an ethylene-vinyl acetate copolymer. E.O. means easy open with an opening force of 1 kgf/15 mm width or lower, E.O.(–) means easy open with an opening force of 1.3 kgf/15 mm width or lower, and T.S. means tight seal or the break of film.

is hard to bond to the inside of the packaging bag by heat-sealing and two resin layers which are strongly melt-bonded to both sides of the poorly sealable resin layer and (b) two outer resin strips which are weakly melt-bonded, respectively, to both sides of the intermediate resin strip to form two melt-bonded interfaces between the intermediate resin strip and the outer resin strips, innermost ends of the melt-bonded interfaces being located more inwardly in the packaging bag than the inner most ends of the heat-sealed parts.

2. The easy-open, hermetically-sealed, packaging bag of claim 1, wherein an outermost end of the poorly sealable resin layer of the intermediate resin strip is located farther outside of the packaging bag than outermost ends of the outer resin strips.

3. The easy-open, hermetically-sealed, packaging bag of claim 2, wherein the outermost end of the melt-bonded poorly sealable resin layer is located farther toward the outside of the packaging bag than outermost ends of the two resin layers and the outermost ends of the outer resin strips.

4. The easy-open, hermetically-sealed, packaging bag of claim 3, wherein the packaging bag is made of a multilayer sheet comprising at least an inner layer of a synthetic resin and an outer layer of a synthetic resin, the synthetic resin of the outer layer being higher in melting point than the synthetic resin of the inner layer.

TABLE 1

| | Packaging bag 1 | | Sealing material: Outer resin strip | Intermediate resin strip 2 | | | Outer resin strip | $t_1$ (mm) | $t_2$ (mm) | Sealing conditions | | Results of opening: Melt-bonded | Heat-sealed |
|---|---|---|---|---|---|---|---|---|---|---|---|---|---|
| | Outer layer | Inner layer | 6 Multilayer sheet | 4 | resin layer 3 | 5 Multilayer sheet | 7 | | | Sealing Temp. | Sealing time | inter-face 8 | part 9 |
| Example 1 | ONY (15μ) | CPP (50μ) | CPP (20μ) | LLDPE (20μ) | LLDPE (20μ) | LLDPE (20μ) | CPP (20μ) | 5 | 5 | 165° C. | 0.5 sec | E.O. | T.S. |
| Example 2 | ONY (15μ) | CPP (50μ) | CPP (20μ) | PB-1 + EVA (20μ) | LLDPE (20μ) | PB-1 + EVA (20μ) | CPP (20μ) | 5 | 5 | 155° C. | 0.5 sec | E.O. | T.S. |
| Example 3 | ONY (15μ) | CPP (50μ) | CPP (20μ) | PB-1 + EVA (20μ) | LLDPE (20μ) | PB-1 + EVA (20μ) | CPP (20μ) | 5 | 5 | 155° C. | 1.0 sec | E.O. | T.S. |
| Example 4 | ONY (15μ) | CPP (50μ) | CPP (20μ) | PB-1 + EVA (20μ) | LLDPE (20μ) | PB-1 + EVA (20μ) | CPP (20μ) | 0 | 5 | 155° C. | 1.0 sec | E.O. (—) | T.S. |
| Example 5 | ONY (15μ) | CPP (50μ) | CPP (20μ) | PB-1 + EVA (20μ) | LLDPE (20μ) | PB-1 + EVA (20μ) | CPP (20μ) | 0 | 5 | 155° C. | 0.5 sec | E.O. | T.S. |
| Example 6 | ONY (15μ) | CPP (50μ) | CPP (20μ) | PB-1 + EVA (20μ) | LLDPE (20μ) | PB-1 + EVA (20μ) | CPP (20μ) | 5 | 0.5 | 155° C. | 0.5 sec | E.O. | T.S. |
| Comp. Ex. 1 | ONY (15μ) | CPP (50μ) | CPP (20μ) | PB-1 + EVA (20μ) | LLDPE (20μ) | PB-1 + EVA (20μ) | CPP (20μ) | 5 | 0 | 155° C. | 0.5 sec | E.O. | E.O. |
| Comp. Ex. 2 | ONY (15μ) | LLDPE (30μ) | LLDPE (30μ) | LLDPE (30μ) | LLDPE (30μ) | LLDPE (30μ) | LLDPE (30μ) | 5 | 5 | 165° C. | 0.5 sec | T.S. | T.S. |

What is claimed is:

1. An easy-open, hermetically-sealed, packaging bag, comprising a packaging bag and a sealing material in a strip form, the packaging bag having an opening end which is hermetically sealed, with the sealing material interposed therein, and with the inside of the opening end being strongly bonded to both sides of the sealing material by heat-sealing to form two heat-sealed parts between the inside of the packaging bag and the both sides of the sealing material, the sealing material comprising (a) an intermediate resin strip consisting of a poorly sealable resin layer which

5. The easy-open, hermetically-sealed packaging bag of claim 4, wherein the outer layer of the packaging bag is an oriented nylon layer, the inner layer of the packaging bag is a layer of a polypropylene, each of the outer resin strips is a strip of a polypropylene, each of both of the resin layers is a layer of a linear low density polyethylene or a mixture of a polybutene-1 and an ethylene-vinyl acetate copolymer, and the poorly sealable resin layer is a layer of a linear low density polyethylene.

* * * * *

UNITED STATES PATENT AND TRADEMARK OFFICE

CERTIFICATE OF CORRECTION

PATENT NO. : 5,538,345

DATED : July 23, 1996

INVENTOR(S) : GOTOH et al

It is certified that error appears in the above-indentified patent and that said Letters Patent is hereby corrected as shown below:

On the Title Page, left-hand column

"[73] Assignee: Idemitsy Petrochemical Co., Ltd.
Tokyo, Japan"

should read:

--[73] Assignee: Idemitsu Petrochemical Co., Ltd.
Tokyo, Japan--

Signed and Sealed this

Sixteenth Day of June, 1998

*Attest:*

Bruce Lehman

BRUCE LEHMAN

*Attesting Officer*

*Commissioner of Patents and Trademarks*